US006416362B1

(12) United States Patent
Conrad et al.

(10) Patent No.: US 6,416,362 B1
(45) Date of Patent: Jul. 9, 2002

(54) PLUG ADAPTER WITH SAFETY SWITCH

(76) Inventors: Charles A. Conrad, 15911 Harwick, Spring, TX (US) 77379; Manoj G. Perera, 2618 Montview Dr., Pearland, TX (US) 77584

( * ) Notice: Subject to any disclaimer, the term of this patent is extended or adjusted under 35 U.S.C. 154(b) by 0 days.

(21) Appl. No.: 09/766,111

(22) Filed: Jan. 19, 2001

(51) Int. Cl.[7] ..... H01R 25/00
(52) U.S. Cl. ..... 439/651; 439/346; 200/51 R
(58) Field of Search ..... 200/51 R; 439/148, 439/188, 638, 650, 651, 346

(56) References Cited

U.S. PATENT DOCUMENTS

| | | | | |
|---|---|---|---|---|
| 2,323,736 A | | 7/1943 | Tousley | 173/361 |
| 2,876,426 A | | 3/1959 | Morse | |
| 2,922,134 A | | 1/1960 | Elfenbein | |
| 2,984,808 A | | 5/1961 | Bender | |
| 2,986,718 A | | 5/1961 | Bender | |
| 3,134,631 A | | 5/1964 | Whalen | |
| 3,178,667 A | | 4/1965 | Morse | |
| 3,219,962 A | | 11/1965 | Whalen | |
| 4,136,919 A | * | 1/1979 | Howard et al. | |
| 5,061,199 A | * | 10/1991 | McClead | 439/304 |
| 5,171,155 A | | 12/1992 | Mendoza | 439/134 |
| 5,243,510 A | * | 9/1993 | Cheney, II | 439/447 |
| 5,338,218 A | * | 8/1994 | Haas | 439/346 |

* cited by examiner

*Primary Examiner*—Khiem Nguyen
(74) *Attorney, Agent, or Firm*—Fulbright & Jaworski L.L.P.

(57) ABSTRACT

This invention is a three-wire grounding electric adapter that is comprised of a body, a first end and a second end wherein said first end has a vertical planar face capable of detachably engaging a 3-wire electric cord, said second end has a second vertical planar face. The body has a switch that is mounted on said body for permitting said adapter to complete, or disrupt positive electrical current from electrical receptacle to an electric device of at least two electric contact blades. The blades are fixedly mounted in said second end and extending outwardly from said second vertical planar face for engaging in an electric outlet. A security screw for securing at least one blade of an electric device plug into said adapter locking at least one blade into the adapter.

3 Claims, 3 Drawing Sheets

PLUG ADAPTER WITH SAFETY SWITCH

FIELD OF THE INVENTION

This invention relates to electrical adapters, and more particularly to improved 3-wire, grounding type adapter with an on/off switch and a locking mechanism.

BACKGROUND OF THE INVENTION

The hazard of operating ungrounded electrical devices is well recognized. As a result, the Underwriter's Laboratories, Inc. and many electrical codes long have required that all portable electrical tools be equipped with suitable grounding means.

The "Underwriter's" have required that plugs for electrical devices be equipped with a three-prong plug for insertion into a 3-wire receptacle.

Over the years, a variety of three-prong plugs have been patented, see U.S. Pat. Nos. 2,323,736; 2,922,134; 2,986,718; 2,876,426; 3,134,631; 3,178,667; 3,219,962; and 2,984,808.

As disclosed in U.S. Pat. No. 2,323,736, there is shown a three-prong plug in which the ground prong is capable of being retracted from a position of use, depending on whether or not a 3-wire electrical outlet is encountered.

When retracted for use with a 2-wire outlet, however, this leaves the electrical device with which the plug is associated ungrounded. U.S. Pat. No. 2,984,808 discloses another three-prong convertible plug in which the ground plug can be pivoted into the use position or not as desired. A "pig-tail" connection is provided on the plug, and in connection with the ground, for connection to the ground screw of a 2-wire receptacle. Another three-prong plug in which a pivotable ground prong is provided is disclosed in U.S. Pat. No. 2,986,718. A "pig-tail" is provided which connects to the ground and which is provided with a connection at the other end for connection to the ground screw in case of use with a 2-wire electrical outlet.

U.S. Pat. Nos. 2,876,426 and 2,922,134 disclose electrical connecting plugs in which a pivotable grounding element is provided. The ground prong on encountering the 2-wire outlet is pivoted so that the finger portion of the grounding prong is out of position so that the connecting plug can be used. In U.S. Pat. No. 2,876,426, the other end of the pivoted prong is constructed so that on the prong being pivoted, it is in contact with the grounded receptacle plate and, in turn, grounds the electrical device.

U.S. Pat. No. 3,134,631 discloses another three-prong electrical plug in which the ground prong is pivotable out of position in case the plug is used with a 2-wire electrical outlet. The ground prong is provided with a groove adjacent its free end for insertion of a ground wire which in turn can be connected to a ground lead in the electrical outlet. A further electrical plug which is provided a pivotable prong is disclosed in U.S. Pat. No. 3,178,667. When a 2-wire outlet is encountered, the pivotable ground prong therein is resiliently urged against the faceplate of the receptacle to establish a ground, thereby reducing the possibility of a shock being transmitted to the user of an electrical device.

U.S. Pat. No. 3,219,962 discloses an electrical connector plug in which a pivotable ground prong is provided and which is disclosed for use with either a 2 or 3-wire receptacle. The ground plug is biased to its operative position.

Note also U.S. Pat. No. 5,171,155, which teaches the use of safety locks for electrical appliances.

While all of the electrical plugs as above disclosed are suitable to a degree, their use does involve certain problems and disadvantages. None of the referenced adapters uses a switch with a 3-prong grounding plug and a security screw for attaching a plug of an electric cord to a power on/off switching device.

SUMMARY OF THE INVENTION

A three-wire grounding electric adapter comprising:

(a) a body comprising a first end and a second end wherein the first end has a vertical planar face capable of detachably engaging a 3-wire electric cord, and the second end has a second vertical planar face;

(b) a switch mounted on the body for permitting the adapter to complete or disrupt positive electrical current from electrical receptacle to an electric device;

(c) at least two electric contact blades fixedly mounted in the second end and extending outwardly from the second vertical planar face for engaging in an electric outlet; and (d) a security screw for securing at least one blade of an electric device plug into the adapter locking at least one blade into the adapter.

BRIEF DESCRIPTION OF THE DRAWING

The invention will be best understood in the following detailed description of a preferred embodiment thereof, taken in connection with the appended drawings in which.

DETAILED DESCRIPTION OF THE INVENTION AND THE PREFERRED EMBODIMENTS

The present invention is designed to have a switching mechanism and a secure locking mechanism to prevent use of electrical devices including home audio/video equipment, power tools and the like which have electrical cords. The adapter is usable in electrical plug receptacles with three slots to receive a standard U.S. plug (of either two prong or three prong ground design) made of an insulating material such as a plastic. The plug of any electrical device is inserted into the adapter and a locking pin is secured to the blade of the plug by rotating a locking screw with a security key tool having a unique top. A convenient tie strap is attached to the adapter to secure the adapter to the electrical cord of an appliance that the user wishes to lock up. The adapter is designed as a locking mechanism for the plug of an electrical receptacle for any electrical device's plug and at the other end a set of electrical prongs (plug) which may be subsequently inserted into an electrical outlet receptacle. The adapter is also additionally designed to contain an electronically keyed remote on/off switch or remote switch which allows power flow to be controlled. Miniature tumbler switch locks which can be used within the scope of this invention and include. Miniature carrier transmitters can be used in the scope of this invention such as Levitons' hand held controller, which permits wireless control of the cord through a transceiver catalog number 6314-W.

Figure 1:
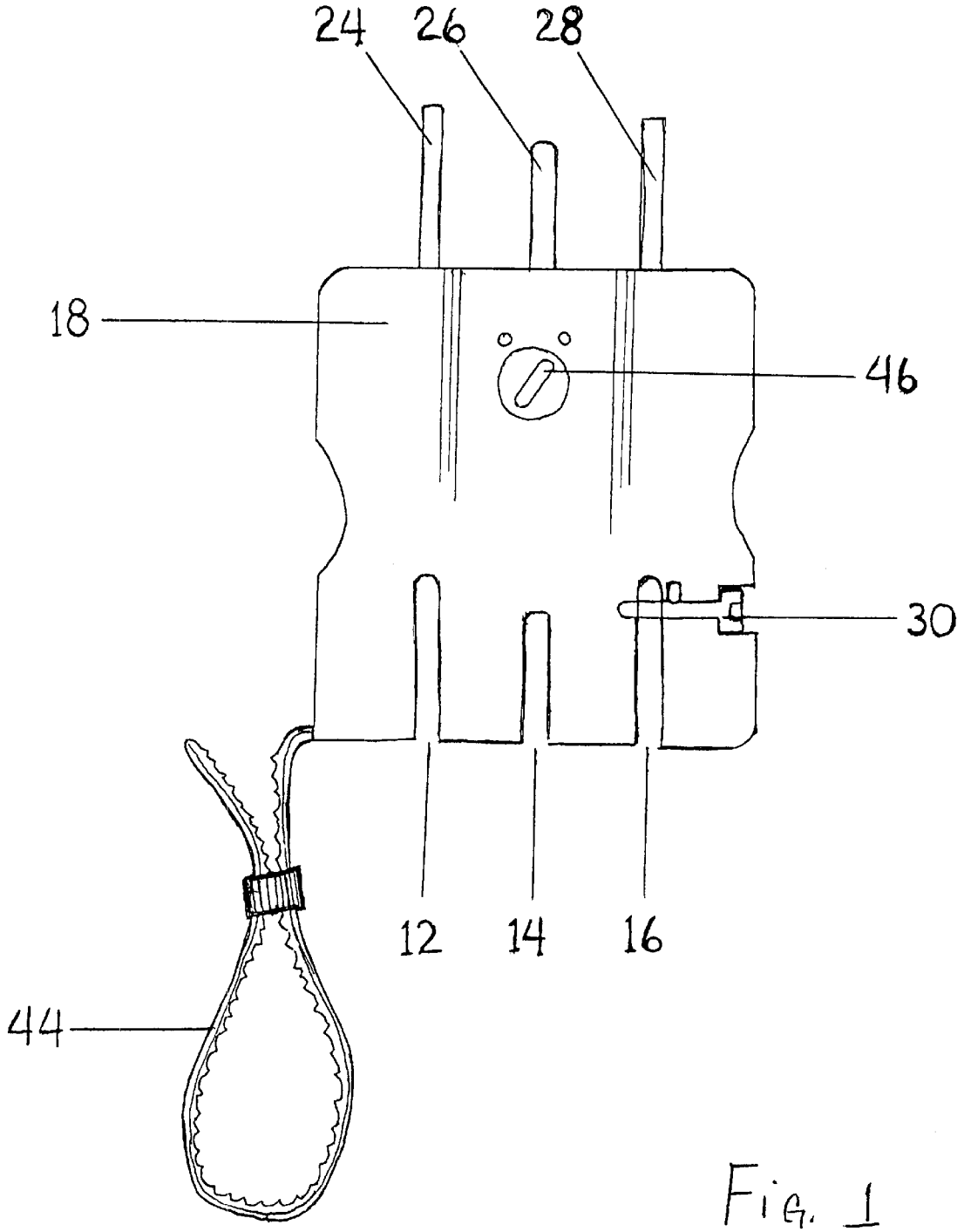
FIG. 1 is a perspective view of an adapter in accordance with the invention.

Turning now to the drawing, there is shown herein in FIG. 1 a self-grounding electric adapter 10 having three cavities 12, 14, 16 for receiving the blades of a 3-wire electric conductor cord connected to an electrical device such as a portable hand tool. The electric adapter 10 comprises a body 18 having a first end 20 with a planar face capable of detachably mating with a three prong plug from an electrical device, such as a power sander.

Adapter body 18 has a second end 22 with prongs 24, 26 and 28 suitable for insertion into either a two or three wire electrical outlet.

The shapes of cavities 12, 14 and 16 need be of a shape capable of receiving the blade. The main consideration is that the mating surfaces be complementary so as to provide a suitable detachable combination. In general, the mating surfaces will fit together, male and female; however, this mating can take various configurations.

Figure 2:
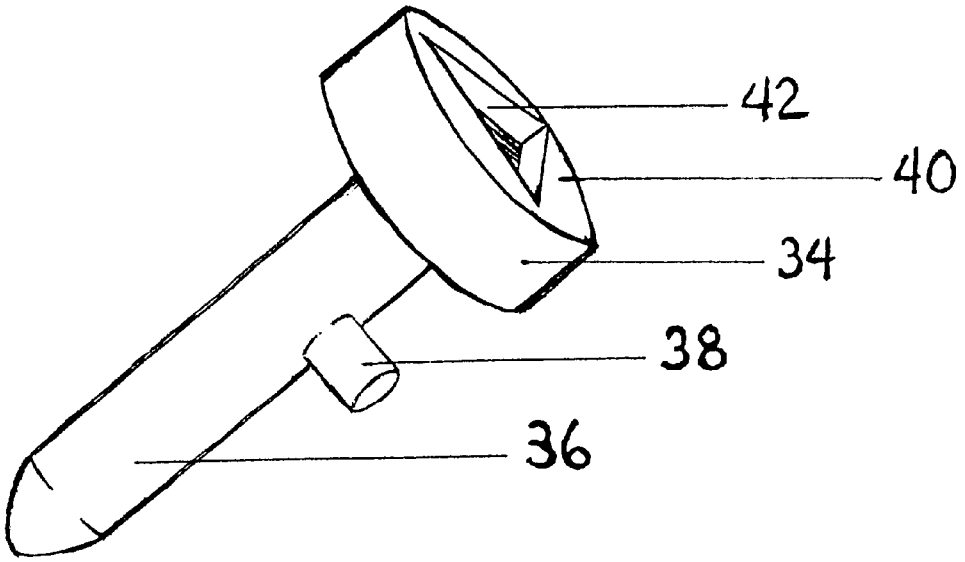
FIG. 2 is a view of the security screw.

FIG. 2 shows the unique locking security screw 30 as used in a cavity 32 of FIG. 1, which enables the security screw 32 to pass through the blade of the inserted electric cord and lock the cord blade into the cavity. The screw 32, shown in detail in FIG. 2 has a head 34, a shaft 36 and a tab 38. In the preferred embodiment, a security screw tab 38 which fits into a security screw guide channel to insure a secure lock of the screw 32 onto the blade. Head 34 has a top 40 which has an indentation or cavity 42 into which a unique security key tool 13 having the identical shape of the cavity is inserted. The security key tool can be like an allen wrench, but have a face design that is either star shaped, triangle shaped, pentagonal shaped, or in the shape of an octagon, squiggle or spiral.

Figure 3:
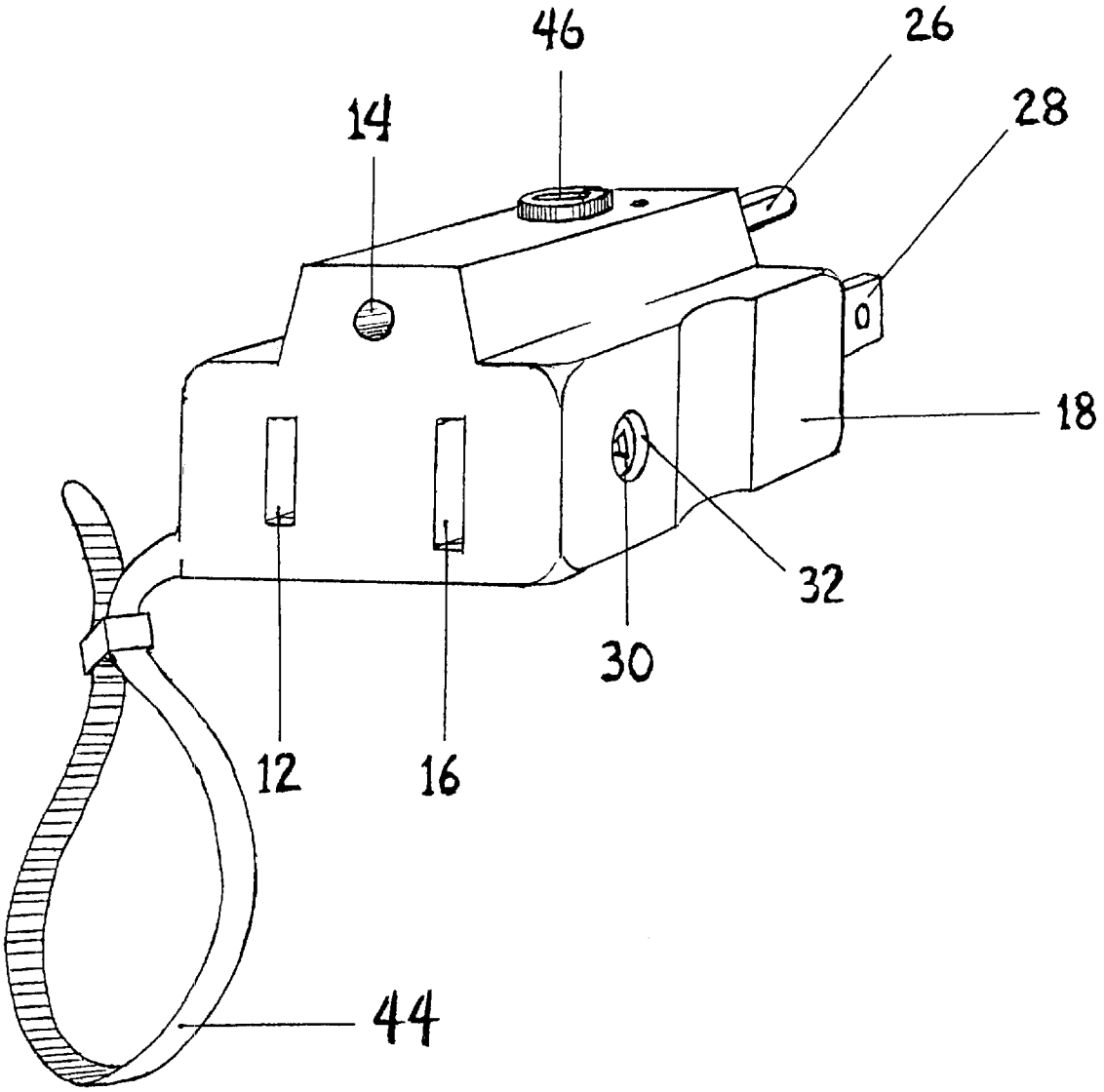
FIG. 3 is an end view of the invention with the switch on the top of the body of the adapter.

FIG. 3 shows an isometric view of the electric adapter wherein cavities 12, 14 and 18 receive the plug from the electric device. Strap 44 can be used to hold the adapter to the cord from the electric device. FIG. 3 shows also the cavity 32 holding security screw 32. Prongs 24, 26 and 28 provide the electrical connection to the wall outlet.

The switch 46 can be a manual switch or an electronic switch in the device which has on and off positions.

The body 18 can be made of rubber or another insulating material, for example, plastic material. These materials for the casing can be chosen to provide a relatively flexible plug body, or one which is more rigid. A flexible plug body is the most preferred. Such a body can be provided through various conventional molding techniques, such as injection molding.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What is claimed is:

1. A three-wire grounding electric adapter comprising:

(a) a body comprising a first end and a second end wherein said first end has a vertical planar face capable of detachably engaging a 3-wire electric cord, said second end has a second vertical planar face;

(b) a switch mounted on said body for permitting said adapter to complete or disrupt positive electrical current from electrical receptacle to an electric device;

(c) at least two electric contact blades fixedly mounted in said second end and extending outwardly from said second vertical planar face for engaging in an electric outlet;

(d) a security screw for securing at least one blade of an electric device plug into said adapter locking at least one blade into the adapter wherein said security screw has a head, a shaft and a tab for lockably engaging at least one blade from a cord of an electric device, and wherein said head has an indentation for receiving the blade of a security key tool having a shape which is selected from the group: star, triangle, pentagon, octagon, a squiggle, and spiral; and (e) wherein said adapter further comprising a strap secured to said casing for restraining the cord from the electrical device.

2. A three-wire grounding electric adapter comprising:

(a) a body comprising a first end and a second end wherein said first end has a vertical planar face capable of detachably engaging a 3-wire electric cord, said second end has a second vertical planar face;

(b) an electronically actuated switch mounted on said body for permitting said adapter to complete or disrupt positive electrical current from electrical receptacle to an electric device;

(c) at least two electric contact blades fixedly mounted in said second end and extending outwardly from said second vertical planar face for engaging in an electric outlet;

(d) a security screw for securing at least one blade of an electric device plug into said adapter locking at least one blade into the adapter;

(e) a power source connected to said electronically actuated switch; and (f) wherein said adapter further comprises a strap secured to said casing for restraining the cord from the electrical device and an electronic on/off switching device by a "keyed" mechanism or an electronic on/off switching device by a remote controlled on/off device.

3. The adapter of claim 2, wherein said power source is a battery.

* * * * *